US007269931B2

(12) United States Patent
Boriani et al.

(10) Patent No.: US 7,269,931 B2
(45) Date of Patent: Sep. 18, 2007

(54) OVERWRAPPING MACHINE FOR PACKETS OF CIGARETTES

(75) Inventors: Silvano Boriani, Bologna (IT); Stefano Negrini, Calderara Di Reno (IT)

(73) Assignee: G.D. Societa per Anzioni (IT)

( * ) Notice: Subject to any disclaimer, the term of this patent is extended or adjusted under 35 U.S.C. 154(b) by 0 days.

(21) Appl. No.: 11/405,301

(22) Filed: Apr. 17, 2006

(65) Prior Publication Data

US 2006/0236657 A1 Oct. 26, 2006

(30) Foreign Application Priority Data

Apr. 22, 2005 (IT) ..... BO2005A0275

(51) Int. Cl.
*B65B 11/30* (2006.01)

(52) U.S. Cl. ..... 53/228; 53/230; 53/234

(58) Field of Classification Search ..... 53/228, 53/230

See application file for complete search history.

(56) References Cited

U.S. PATENT DOCUMENTS 1,996,206 A * 4/1935 Jahne ..... 53/222
2,999,345 A * 9/1961 Chalmers et al. ..... 53/230
4,351,142 A * 9/1982 Focke et al. ..... 53/575
4,495,746 A * 1/1985 Focke et al. ..... 53/389.3
4,603,534 A * 8/1986 Focke ..... 53/231
5,133,173 A * 7/1992 Draghetti et al. ..... 53/466
5,782,063 A * 7/1998 Boriani et al. ..... 53/466
6,085,494 A * 7/2000 Lembke et al. ..... 53/466
6,796,103 B2 * 9/2004 Gamberini ..... 53/228

FOREIGN PATENT DOCUMENTS

GB 898066 A 6/1962

OTHER PUBLICATIONS

Search Report issued by European Patent Office on Jun. 21, 2006 in connection with corresponding European patent application No. EP 06 11 2759.

* cited by examiner

*Primary Examiner*—John Sipos
(74) *Attorney, Agent, or Firm*—Ostrolenk, Faber, Gerb & Soffen, LLP

(57) ABSTRACT

An overwrapping machine for packets of cigarettes, wherein a first feed line feeds the packets of cigarettes successively along a first path, and a second feed line feeds sheets of transparent packing material successively along a second path intersecting the first path at a cross station to pair each packet with a respective sheet of packing material; and wherein a guide for the packets is located upstream from the cross station, and has an output end, for the packets, facing the cross station; the guide is movable to and from a forward operating position, in which the guide forms part of the first path, and the output end of the guide is positioned substantially contacting the second path.

7 Claims, 2 Drawing Sheets

OVERWRAPPING MACHINE FOR PACKETS OF CIGARETTES

The present invention relates to an overwrapping machine for packets of cigarettes.

BACKGROUND OF THE INVENTION

More specifically, the present invention relates to an overwrapping machine, for packets of cigarettes, of the type comprising a first feed line for feeding the packets of cigarettes successively along a first path; a second feed line for feeding sheets of transparent packing material successively along a second path, the first path intersecting the second path at a cross station to pair each packet with a respective sheet of packing material; and a guide, for guiding the packets, located upstream from the cross station and having an output end, for the packets, facing the cross station.

In known overwrapping machines of the type described above, the second feed line normally comprises an output portion defined by two conveyors, which are arranged side by side and a given distance apart through the cross station and along the second path. The two conveyors define a conveying surface for conveying the sheets of packing material through the cross station, and feed the sheets of packing material forward in steps, holding them by their longitudinal edges only, so that, at the cross station, a central portion of each sheet is positioned facing the output end of the packet guide. The two conveyors also define between them a passage through which the packets of cigarettes issuing from the guide are fed successively to engage and draw along the respective sheets of packing material.

Since the transparent material employed on overwrapping machines of the type described above is normally extremely thin and difficult to position, and given the tendency to locate the output end of the guide as close as possible to the conveying surface of the sheets of packing material to control the packets and pairing of the packets with the respective sheets of packing material as accurately as possible, the sheets of packing material engaging the cross station are subject to collision and tearing against the output end of the guide, thus resulting in jamming of the overwrapping machine.

SUMMARY OF THE INVENTION

It is an object of the present invention to provide an overwrapping machine, for packets of cigarettes, designed to substantially eliminate any possibility of interference between the sheets of packing material and the guide at the cross station.

According to the present invention, there is provided an overwrapping machine, for packets of cigarettes, as claimed in the attached claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
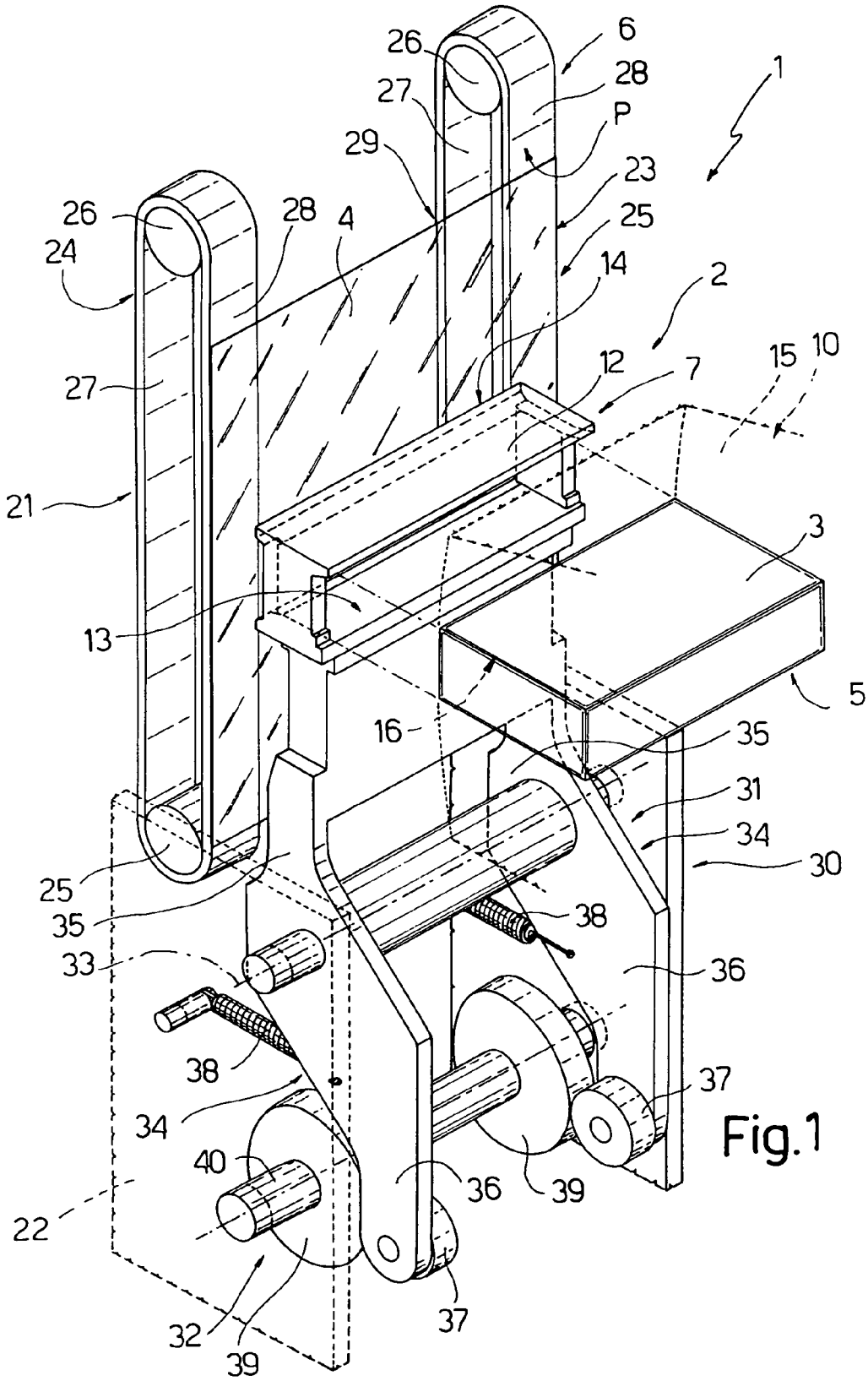
FIG. 1 shows a view in perspective, with parts removed for clarity, of a preferred embodiment of the machine according to the present invention.

Number 1 in FIG. 1 indicates as a whole an overwrapping machine, a central portion 2 of which provides for successively overwrapping packets 3 of cigarettes in respective sheets 4 of transparent packing material.

Central portion 2 comprises a first feed line 5 for feeding packets 3; a second feed line 6 for feeding sheets 4 of packing material; and a cross station 7 where line 5 runs through line 6. More specifically, line 5 feeds packets 3 successively, and crosswise to their respective longitudinal axes, along a substantially straight path 8 extending through line 6 at cross station 7; and line 6 feeds sheets 4 of packing material successively along a straight path 9 crosswise to path 8, and supplies sheets 4 of packing material to cross station 7 in time with respective packets 3, so that each packet 3 engages a respective sheet 4 of packing material, and draws sheet 4 of packing material off line 6 and along line 5.

Figure 3:
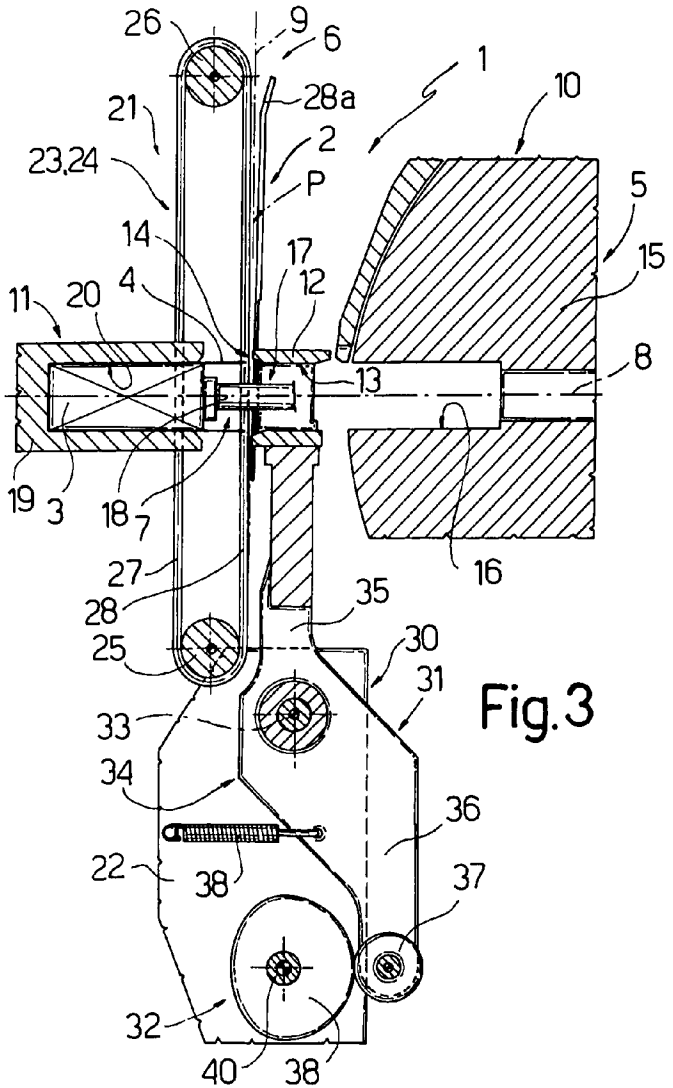
FIGS. 2 and 3 show axial sections of the FIG. 1 machine in two different operating positions.
Figure 2:
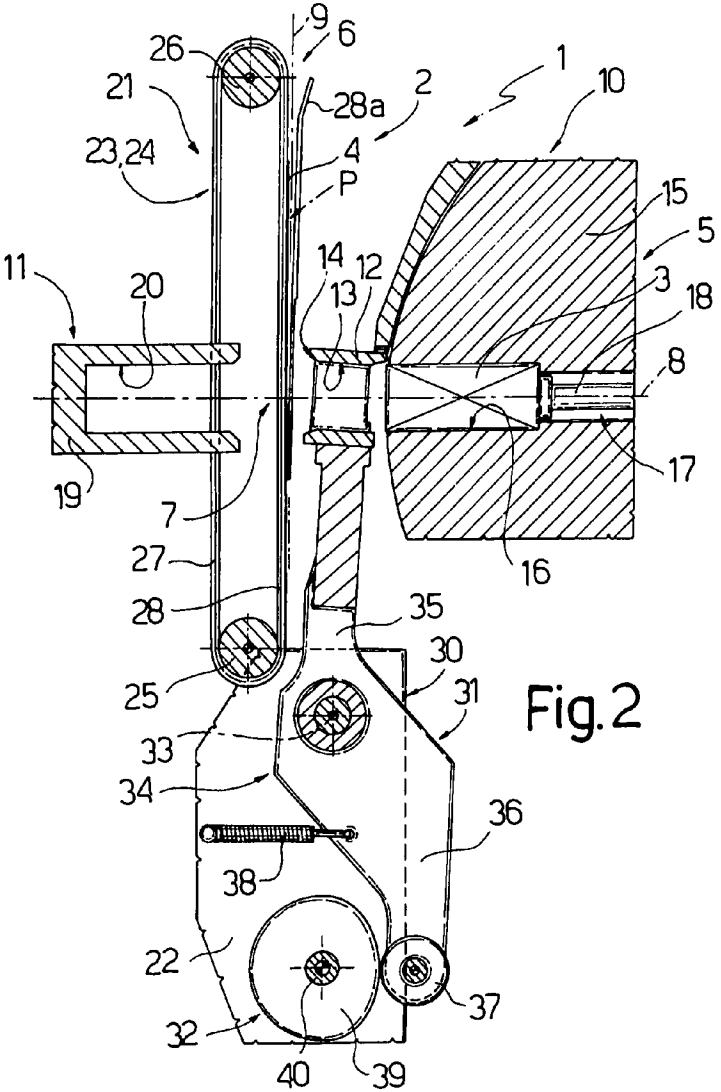

As shown in FIGS. 2 and 3, line 5 comprises two conveying devices 10 and 11 located in series along path 8 and on opposite sides of line 6, and therefore of cross station 7; and a tubular lead-in guide 12 located along path 8, upstream from cross station 7, and in an intermediate position between conveyor device 10 and cross station 7, and in turn comprising an inner conduit 13 which permits passage of packets 3, communicates with conveying device 10 and cross station 7, and has an output end 14 crosswise to path 8 and facing path 9.

Conveying device 10 comprises a known feed wheel 15 rotating in steps about an axis (not shown) and having a number of peripheral pockets or seats 16 (only one shown), and a push device 17, which comprises a rod 18 movable back and forth along path 8 to expel each packet 3 from relative pocket 16 and subsequently feed each packet 3 through conduit 13 when pocket 16 is arrested, in use, in a position aligned with conduit 13 and path 8.

Conveying device 11 comprises a conveyor wheel 19 rotating in steps about a respective axis (not shown) and having peripheral pockets or seats 20 (only one shown), each of which travels through cross station 7 and, when aligned with path 8, receives a packet 3 and respective sheet 4 of packing material as explained in detail below.

As shown in the accompanying drawings, feed line 6 comprises a conveying device 21, which is fitted to a frame 22, forming a fixed portion of machine 1, and provides for receiving sheets 4 of packing material, feeding them in steps along path 9, and arresting them at cross station 7.

Conveying device 21 comprises two substantially identical belt conveyors 23 and 24, located on opposite sides of path 9 and separated by a distance approximating but no more than the width of a sheet 4 of packing material. Each conveyor 23, 24 comprises a drive pulley 25 fitted to frame 22 and rotating clockwise in FIG. 1, and a driven pulley 26 fitted idly to frame 22 and located on the opposite side of path 8 to relative drive pulley 25.

Drive pulley 25 and driven pulley 26 of each conveyor 23, 24 support a respective endless belt 27 comprising a conveying branch 28 facing and substantially tangent to output end 14 of tubular lead-in guide 12, and which, together with conveying branch 28 of the other conveyor 24, 23, defines a conveying surface P for conveying sheets 4 of packing material through cross station 7. Belts 27 are located a given distance apart to define between them a passage 29 large enough to allow a packet 3 travelling along path 8 to travel through line 6; and each conveying branch 28 is associated, upstream from the intersection with path 8, with a respective elastic retaining plate 28*a* for retaining a relative lateral edge of each sheet 4 of packing material engaging cross station 7.

As shown more clearly in FIG. 1, frame 22 comprises two plates defining a fork 30 supporting a further frame 31, which is fitted integrally with tubular lead-in guide 12, and which oscillates—with respect to frame 22, under the control of an actuating device 32, and about an axis 33 parallel to the axes of pulleys 25 and 26—between a forward operating position (FIGS. 1 and 3) in which conduit 13 of tubular lead-in guide 12 defines a portion of path 8 and is positioned with output end 14 substantially tangent to conveying surface P, and a withdrawn position (FIG. 2) in which tubular lead-in guide 12 is tilted with respect to path 8, with output end 14 at a given distance from conveying surface P.

As shown more clearly in FIG. 1, frame 31 is defined by two side by side rocker arms 34 hinged to fork 30 to rotate with respect to frame 22 about axis 33. A variation, not shown, employs only one rocker arm integral with tubular lead-in guide 12.

Each rocker arm 34 comprises an arm 35 facing cross station 7 and connected integrally to arm 35 of the other rocker arm 34 by tubular lead-in guide 12; and a further arm 36 fitted on its free end with a cam follower 37 held by a spring 38 in contact with a respective cam 39 fitted to a powered shaft 40 in turn fitted to frame 22 and parallel to axis 33. Powered shaft 40 and cams 39 define actuating device 32, and, for each complete rotation of powered shaft 40 about its axis, frame 31 performs a complete back and forth oscillation cycle between said forward operating position in which output end 14 of tubular lead-in guide 12 is substantially coplanar with conveying surface P, and said withdrawn position in which output end 14 of tubular lead-in guide 12 is located a given distance from the conveying surface.

More specifically, actuating device 32 oscillates frame 31 substantially in phase opposition to line 6, so as to withdraw tubular lead-on guide 12 from cross station 7 and from conveying surface P when a sheet 4 of packing material enters cross station 7.

In actual use, when a sheet 4 of packing material enters and is arrested in cross station 7 (FIG. 2), actuating device 32 moves tubular lead-on guide 12 into the withdrawn position, and, at the same time, a seat 16 housing a respective packet 3 is moved by feed wheel 15 into line with path 8, and an empty seat 20 is fed by conveyor wheel 19 into line with path 8.

Only when the leading edge of sheet 4 of packing material has passed the intersection with path 8, does actuating device 32—which has already begun moving tubular lead-in guide 12 towards conveying surface P—restore tubular lead-in guide 12 to the forward position in line with path 8, and with output end 14 substantially contacting conveying surface P and, therefore, sheet 4 of packing material inside cross station 7.

At this point, push device 17 is activated to transfer packet 3 along path 8 and through cross station 7, so as to feed packet 3, and respective sheet 4 of packing material folded into a U about packet 3, into the seat 20 aligned with path 8.

The invention claimed is:

1. An overwrapping machine for packets of cigarettes, the machine comprising a first feed line for feeding the packets of cigarettes successively along a first path; a second feed line for feeding sheets of transparent packing material successively along a second path, the first path intersecting the second path at a cross station to pair each packet with a respective sheet of packing material; and a guide, for the packets, located upstream from the cross station relative the first path, and having an output end, for the packets, facing the cross station an actuating means for moving the guide to and from a forward operating position, in which the guide forms part of the first path and said output end is positioned substantially contacting the second path without creating any creases in the sheet in the second path.

2. A machine as claimed in claim 1, and comprising an oscillating frame oscillating about an axis crosswise to the first and second path; the oscillating frame supporting the guide; said actuating mechanism being provided to oscillate the oscillating frame substantially in phase opposition to the second feed line, so as to withdraw the guide from the cross station when a sheet of packing material enters the cross station.

3. A machine as claimed in claim 2, wherein the oscillating frame comprises at least one rocker arm oscillating about said axis; the rocker arm comprising a first arm connected integrally to the guide, and a second arm connected to the actuating means.

4. A machine as claimed in claim 2, wherein said actuating mechanism are cam actuating means.

5. A machine as claimed in claim 3, wherein the second arm is fitted with a cam follower connected to the cam actuating means.

6. A machine as claimed in claim 1, wherein the second feed line comprises two conveyors, which are parallel and coplanar with each other, define a conveying surface (P) for conveying the sheets of packing material through the cross station, are positioned facing the output end of the guide, and are located a given distance apart so as to engage opposite longitudinal portions of a sheet of packing material in the cross station, and also to define between them a passage for the packets through the second path.

7. A machine as claimed in claim 1, wherein said first feed line comprises first and second conveying means located in series along the first path and on opposite sides of the second feed line; and push means for transferring the packets successively from the first to the second conveying means along the first path and the guide and through the cross station.

* * * * *

UNITED STATES PATENT AND TRADEMARK OFFICE

CERTIFICATE OF CORRECTION

PATENT NO. : 7,269,931 B2
APPLICATION NO. : 11/405301
DATED : September 18, 2007
INVENTOR(S) : Silvano Boriani and Stefano Negrini It is certified that error appears in the above-identified patent and that said Letters Patent is hereby corrected as shown below:

On the Title Page Item (73) should read as:
Assignee: G.D Societa per Azioni (IT)

Signed and Sealed this

Twenty-seventh Day of May, 2008

JON W. DUDAS
*Director of the United States Patent and Trademark Office*